United States Patent [19]

Meyer et al.

[11] Patent Number: 5,057,654

[45] Date of Patent: Oct. 15, 1991

[54] INTERRUPTING UNIT WITH MOLDED HOUSING AND SHUNT CURRENT PATH THERETHROUGH

[75] Inventors: Peter J. Meyer, Evanston; Leonard V. Chabala, Maywood; Edward J. Rogers, Chicago, all of Ill.

[73] Assignee: S&C Electric Company, Chicago, Ill.

[21] Appl. No.: 273,399

[22] Filed: Nov. 18, 1988

[51] Int. Cl.[5] ..... H01H 9/38; H01H 33/12

[52] U.S. Cl. ..... 200/146 R

[58] Field of Search ..... 200/144 R, 144 C, 146 R

[56] References Cited

U.S. PATENT DOCUMENTS 4,103,129 7/1958 Evans et al. ..... 200/144 R

*Primary Examiner*—J. R. Scott

*Attorney, Agent, or Firm*—James V. Lapacek

[57] ABSTRACT

An interrupting unit for a switch is provided that includes the efficient combination of a molded housing and a shunt current path therethrough. The shunt current path includes easily assembled components that provide positive contact at a point in the current path at which the components are relatively movable with respect to each other. The interrupting unit includes an operating mechanism with movable linkage components that operate the shunt interrupting contacts. The linkage components also provide a portion of the shunt current path. The shunt current path also includes a stationary auxiliary contact which extends outside the molded housing and which is cooperable with a moving auxiliary shunt contact of an overall interrupting switch. The molded housing includes a cover portion having a section that extends beyond the main integrally molded housing portion. The stationary auxiliary contact is a protruding member or stud disposed from the extending section of the cover portion. The cover portion of the molded housing carries integrally molded conductive provisions for connecting the externally disposed stationary auxiliary contact to the movable linkage portions of the operating mechanism internal to the molded housing. The provisions in the shunt current path that connect the externally disposed stationary auxiliary contact and the movable linkage portions of the operating mechanism also includes a depending resilient contact or wiper arm which engages a movable wiper contact surface or hub of the movable linkage to provide appropriate contact engagement.

5 Claims, 5 Drawing Sheets

INTERRUPTING UNIT WITH MOLDED HOUSING AND SHUNT CURRENT PATH THERETHROUGH

BACKGROUND OF THE INVENTION

1. Field of the Invention

The present invention relates generally to interrupter switches for the power distribution field and more particularly to an interrupting unit that provides an improved combination of a molded housing and a shunt current path.

2. Description of the Related Art

Interrupter switches are known in the electrical power distribution field that provide the capability to interrupt load currents via a shunt current path with interrupting contacts. For example, interrupter switches of this general type are shown in U.S. Pat. Nos. 4,103,129, 3,909,570, 4,126,773, and 4,107,487.

While such arrangements may be suitable for their generally intended purposes, it is desirable to provide an efficient combination of a molded interrupter housing and a shunt current path therethrough. For example, it is desirable to provide an improved shunt current path wherein current transfer is provided between relatively movable parts of the shunt current path.

SUMMARY OF THE INVENTION

Accordingly, it is a principal object of the present invention to provide an interrupting unit for the electrical power distribution field that includes an improved combination of a molded housing and a shunt current path therethrough.

It is another object of the present invention to provide an interrupting unit with an improved shunt current path that includes an improved current-transfer arrangement between relatively movable components.

These and other objects of the present invention are efficiently achieved by the provision of an interrupting unit for a switch that includes the efficient combination of a molded housing and a shunt current path therethrough. The shunt current path includes easily assembled components that provide positive contact at a point in the current path at which the components are relatively movable with respect to each other. The interrupting unit includes an operating mechanism with movable linkage components that operate the shunt interrupting contacts. The linkage components also provide a portion of the shunt current path. The shunt current path also includes a stationary auxiliary contact which extends outside the molded housing and which is cooperable with a moving auxiliary shunt contact of an overall interrupting switch. The molded housing includes a cover portion having a section that extends beyond the main integrally molded housing portion. The stationary auxiliary contact is a protruding member or stud disposed from the extending section of the cover portion. The cover portion of the molded housing carries integrally molded conductive provisions for connecting the externally disposed stationary auxiliary contact to the movable linkage portions of the operating mechanism internal to the molded housing. The provisions in the shunt current path that connect the externally disposed stationary auxiliary contact and the movable linkage portions of the operating mechanism also include a depending resilient contact or wiper arm which engages a movable wiper contact surface or hub of the movable linkage to provide appropriate contact engagement.

BRIEF DESCRIPTION OF THE DRAWING

The invention, both as to its organization and method of operation, together with further objects and advantages thereof, will best be understood by reference to the following specification taken in conjunction with the accompanying drawing in which.

DETAILED DESCRIPTION

Figure 1:
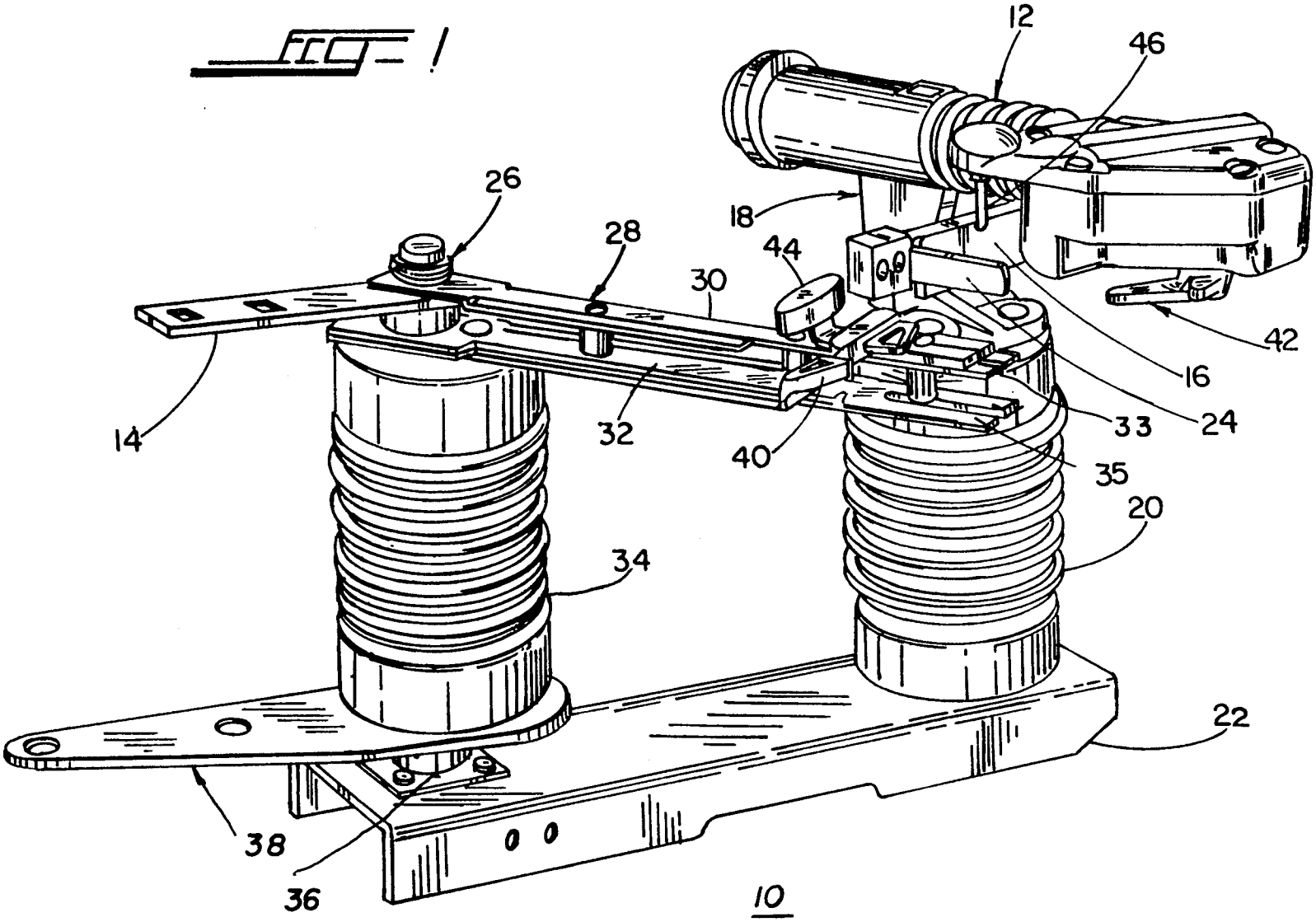
FIG. 1 is a perspective view of the interrupter unit of the present invention illustrated in conjunction with an overall interrupter switch assembly.

Referring now to FIG. 1, there is illustrated an interrupter switch assembly 10 which is exemplary of a type of switch that utilizes an interrupting unit 12 of the present invention. However, it should be realized that the interrupting unit 12 of the present invention may be utilized in a variety of switch assemblies of varied mounting configurations and orientations. The switch assembly 10 is connected in any of a variety of electrical distribution circuits via a first terminal pad 14 found at the top left side of FIG. 1 and a second terminal pad 16 illustrated at the right side of FIG. 1. The second terminal pad 16 is carried by a bracket 18 which also supports the interrupting unit 12. The bracket 18 is attached to an insulator 20 which in turn is supported by a base 22 of the switch assembly 10. The second terminal pad 16 is also fabricated to include a stationary main contact 24 which is generally tongue shaped. The first terminal pad 14 is electrically connected to a movable contact assembly 28 via hinge contact facilities generally illustrated at 26. The movable contact assembly 28 includes two spaced-apart blades 30,32 with moving main contacts 33,35 respectively at the ends of the blades 30,32 distal to the hinge contact facilities 26. The moving main contact portions 33,35 are especially adapted for cooperation with the stationary main contact 24 and provide a jaw contact for the switch assembly 10; the contacts 33,35 and 24 establishing the main current-carrying path for load current in the connected electrical circuit.

The movable contact assembly 28 is supported by an insulator 34 via the hinge contact facilities 26. The insulator 34 is rotatably mounted with respect to the base 22 via facilities generally illustrated at 36. A lever 38 is affixed to the insulator 34 and is rotatable via suitable linkage connections (not shown) to rotate the insulator 34 and the carried movable contact assembly 28 while the terminal pad 14 remains fixed in electrical circuit connection.

As is known to those skilled in the art, to minimize arcing effects, the movable contact assembly 28 is rapidly moved from the generally open position shown in FIG. 1 to a position where the moving main contacts 33,35 are in engagement with the stationary contact 24. Of course, as is also known to those skilled in the art, the moving main contacts 33,35 and the stationary contact 24 are specially fabricated with features to minimize contact erosion and deterioration due to arcing. Accordingly, the main current path includes: the first terminal pad 14; the hinge contact facilities 26; the movable contact assembly 28 and moving main contacts 33,35; the stationary contact 24; and the second terminal pad 16.

When it is desired to open the main current path and separate the moving main contacts 34,36 (hereinafter referred to as jaw contacts) from the stationary contact 24, the insulator 34 and the movable contact assembly 28 are rotated for disengagement of the jaw contacts 33,35 from the stationary contact 24. However, as is also well known to those skilled in the art, if the contacts are opened when current is flowing in the main current path, arcing and deleterious effects to the switch assembly 10 would occur without the provision of load interruption facilities in the switch assembly 10. To that end, the interrupter unit 12 includes interrupting contacts and provisions to establish a shunt current path in parallel with the stationary contact 24 and the jaw contacts 33,35 before these main contacts separate; the interrupting contacts interrupting the circuit internal to the interrupter unit 12 only after the jaw contacts 33,35 and the stationary contact 24 have been suitably separated toward the open position of FIG. 1. Thus, any flash-over or external arcing is avoided between the movable contact assembly 28 and the stationary contact 24. For a more detailed discussion, reference may be made to U.S. Pat. Nos. 4,103,129, 3,909,570, 4,126,773 and 4,107,487.

As will be described in more detail in discussion of FIGS. 2–9, a moving auxiliary contact 44 carried by the movable contact assembly 28 and a stationary auxiliary contact 46 carried by the interrupter unit 12 function as shunt contacts in a shunt current path such that the load current is transferred to the shunt path before the disengagement of the stationary contact 24 from the jaw contacts 33,35. As the movable contact assembly 28 is being moved from the closed to the open position, but while the jaw contacts 33,35 are still in engagement with the stationary contact 24, the moving auxiliary contact 44 is positioned in suitable conductive engagement with the externally disposed stationary auxiliary contact 46 carried by the interrupter unit 12, thus establishing the shunt current path.

To provide the appropriate establishing of the shunt current path and the appropriate sequenced operation of the interrupting contacts internal to the interrupter unit 12, the movable contact assembly 28 carries an operating cam generally illustrated at 40. The operating cam 40 includes provisions that cooperate with a movable trigger assembly 42 of the interrupter unit 12. Specifically, with the shunt current path established, as the movable contact assembly 28 moves from the closed position such that the jaw contacts 33,35 are separated a suitable distance from the stationary contact 24, an opening cam portion of the operating cam 40 operates the trigger assembly 42 to open the internal interrupting contacts of the interrupter unit 12. A closing cam portion of the operating cam 40 operates the trigger assembly 42 to close the internal interrupting contacts of the interrupter unit 12 during the closing of the main contacts 33, 35, and 12.

Figure 2:
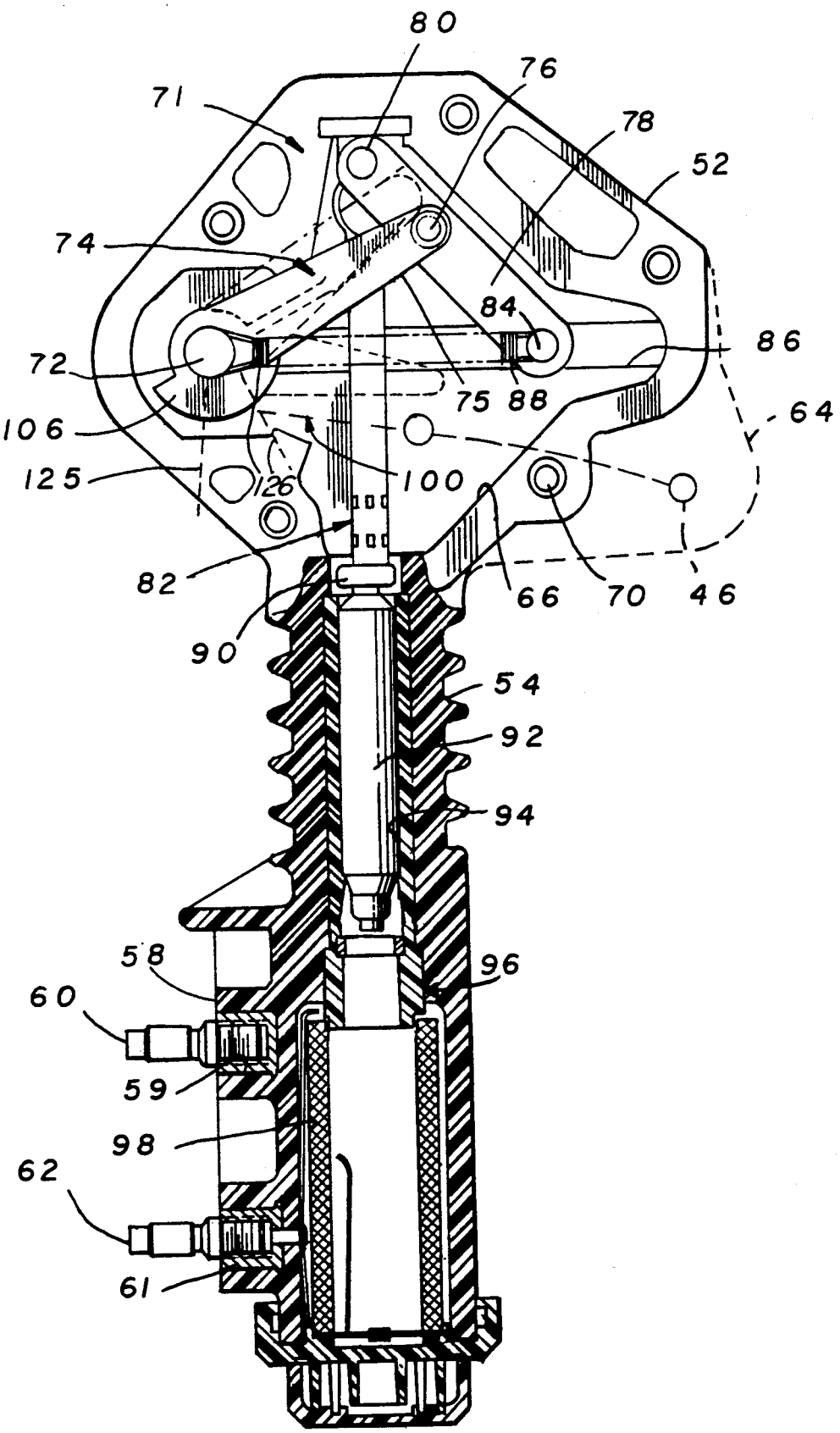
FIG. 2 is an elevational view, partly in section, of the interrupter unit of FIG. 1 with a cover portion of the housing being removed for clarity.
Figure 3:
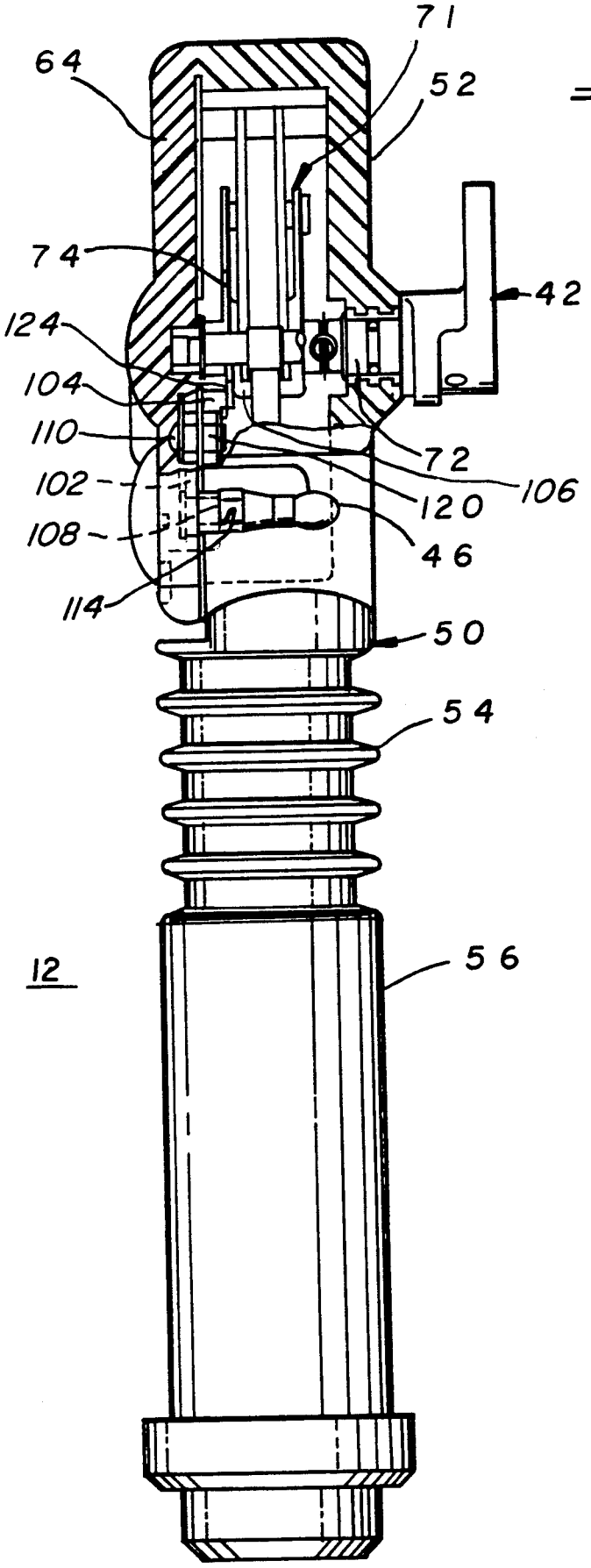
FIG. 3 is a right side elevational view of the interrupter unit of FIG. 2, partly in section.
Figure 4:
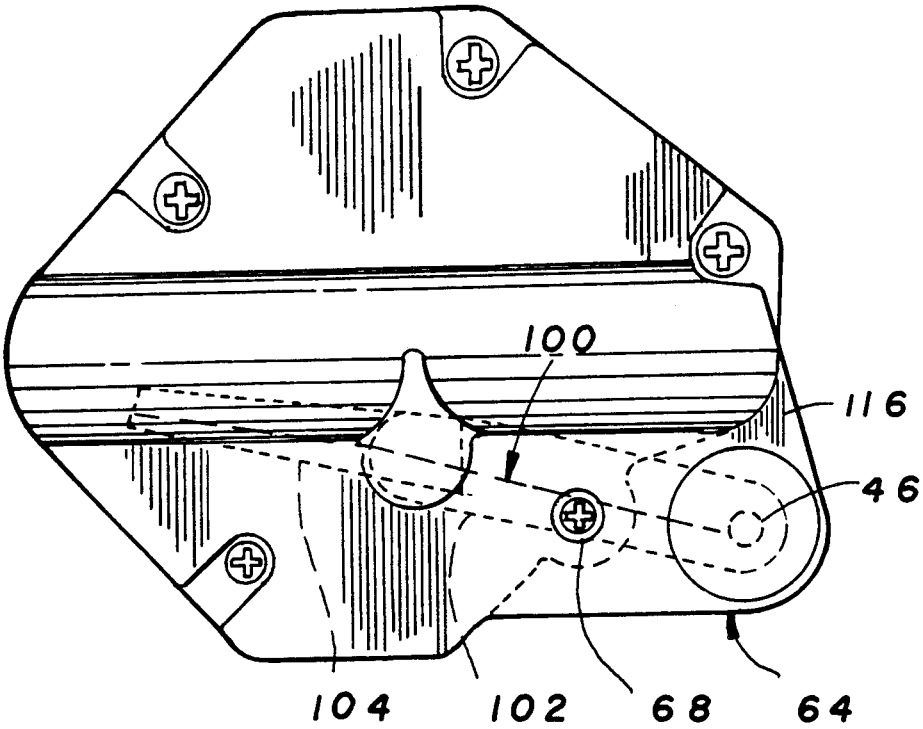
FIG. 4 is a top elevational view of the cover portion of the interrupter unit of FIGS. 1–3.

In accordance with important aspects of the present invention and referring additionally to FIGS. 2–4, the interrupter unit 12 provides an internal shunt current path from the stationary auxiliary contact 46 to a conductive mounting stud 62 that affixes the interrupter unit 12 to the conductive bracket 18 which establishes electrical connection to the second terminal pad 16. Accordingly, the shunt current path that is established before separation of the stationary contact 24 from the jaw contacts 33,35 includes the path through the first terminal pad 14, the movable contact assembly 28, the moving auxiliary contact 44, the stationary auxiliary contact 46, the internal path defined within the interrupter unit 12 including portions of an operating mechanism and the internal interrupting contacts, the mounting stud 62, the bracket 18, and the second terminal pad 16.

Specifically, and as will be described in more detail hereinafter, the shunt current path provided from the stationary auxiliary contact 46 to the bracket 18 includes an integrally molded conductive portion and connection through movable linkage components of an operating mechanism (generally referred to at 71 in FIGS. 2 and 3) carried within the interrupter unit 12; the movable linkage components of the operating mechanism 71 establishing the shunt current path through the internal interrupting contacts (90,96 in FIG. 2).

The interrupter unit 12 includes a housing 50 molded of insulating material such as glass-reinforced polyester. The integrally molded housing 50 includes an operating mechanism enclosing portion 52 and insulator portion 54 and a muffler or exhaust-control portion 56. The housing portions 52, 54, and 56 may also be referred to as cavities or volumes. Also integrally molded with the housing 50 is a mounting flange portion 58 (FIG. 2) having molded-in inserts 59,61. The inserts 59,61 are arranged to receive respective mounting studs 60,62 that are utilized for connection to the bracket 18 illustrated in FIG. 1. A molded cover portion 64 is affixed over an opening 66 in the operating mechanism enclosing portion 52 of the housing 50, with the cover portion 64 being affixed via suitable fasteners 68 extending through the cover portion 64 and cooperating with integrally molded-in inserts 70 of the housing 50. The cover portion 64 of the interrupter unit 12 is removed for clarity in FIG. 2 while it is affixed as shown in FIG. 3.

Figure 5:
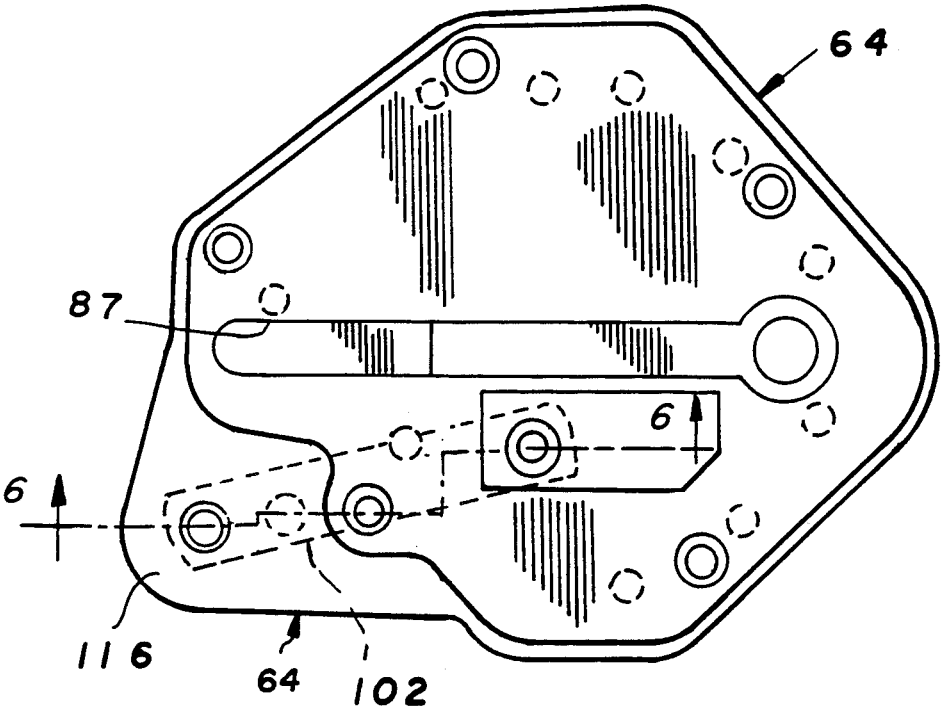
FIG. 5 is a bottom elevational view of the cover portion of FIG. 4.

The trigger assembly 42 is carried by a shaft 72 that is rotatably mounted with respect to the housing 50. The operating mechanism 71 internal to the interrupter 12 includes a first lever arm assembly 74 that is affixed to the shaft 72. The end 75 of the first lever arm assembly 74 is pivotably connected by a pin 76 to a second lever arm assembly 78 of the operating mechanism 71. The second lever arm assembly 78 is suitably connected at one end by a pin 80 to a movable contact plunger 82. The other end of the second lever arm assembly 78 is pivotally carried by a guide pin 84 which is movable in an integrally molded slotted portion 86 in the housing 50 and an integrally molded slotted portion 87 in the cover portion 64 (FIG. 5). A spring 88 is disposed between the shaft 72 and the guide pin 84. The spring 88 biases the guide pin 84 toward the shaft 72.

Upon rotation of the shaft 72 in a clockwise direction in FIG. 2, the operating mechanism 71 is effective to move the movable contact plunger 82 in a downward direction in FIG. 2 between the open position as illustrated in FIG. 2 and a closed position. The movable contact plunger 82 carries an interrupting contact 90 and a trailer assembly 92, preferably fabricated from arc-extinguishing material. The insulator portion 54 of the housing 50 carries a liner 94: also preferably fabricated from arc-extinguishing material. Also affixed in the insulator portion 54 of the housing 50 is a fixed contact ring defining a stationary interrupting contact 96.

In the closed position, the movable interrupting contact 90 carried by the movable contact plunger 82 is moved from the open position of FIG. 2 to a position aligned within and in electrical contact with the fixed interrupting contact 96; thus, the contacts 90,96 comprise the relatively movable interrupting contacts of the interrupter unit 12. When the contacts 90,96 are separated during the opening of the switch assembly 10, any ensuing arcing is extinguished as the trailer 92 in intimate contact with the liner 94 isolates the contacts 90.96. Additionally, suitable amounts of arc-extinguishing gases are generated by the materials of components 92.94 in response to any arcing that occurs. The stationary interrupting contact 96 is electrically connected to the conductive insert 61 via a conductor 98.

Figure 6:
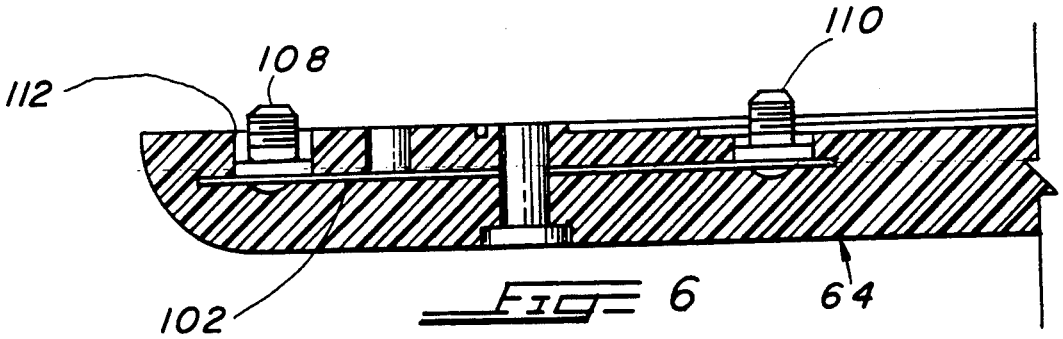
FIG. 6 is a sectional view of the cover portion taken along the line 6—6 of FIG. 5.
Figure 7:
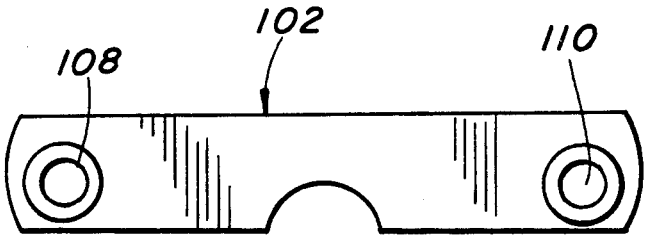
FIG. 7 is an elevational view of an integrally molded conductor of the cover portion of the interrupter unit of FIGS. 1–6.
Figure 8:
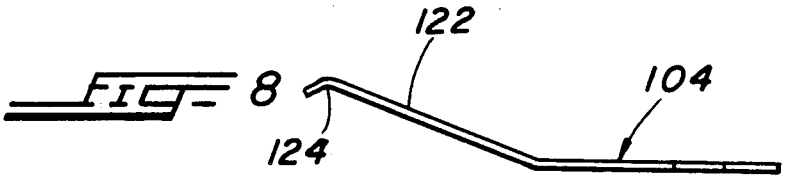
FIG. 8 is an elevational view of a component of a shunt current path of the interrupter unit of FIGS. 1–7.
Figure 9:
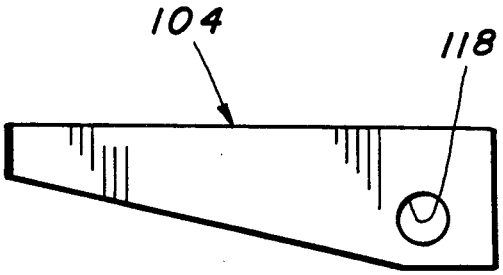
FIG. 9 is a bottom plan view of the component of FIG. 8.

For achievement of the shunt current path, suitable portions of the operating mechanism 71 and the movable contact plunger are conductive so that a current path can be established between the first lever arm assembly 74 and the movable interrupting contact 90. To this end and referring additionally to FIGS. 5–9, the stationary auxiliary contact 46 (FIG. 3) which is disposed external to the housing 12 is electrically connected to the first lever arm assembly 74 via a conductive path 100 indicated by dashed line in FIGS. 2 and 4. The conductive path 100 (which interconnects the stationary auxiliary contact 46 and the lever arm assembly 74) includes a first conductive portion 102 (best seen in FIGS. 6 and 7, but also illustrated in FIGS. 3 and 4) that is integrally molded with the cover portion 64. As seen in FIG. 6, the first conductive portion 102 is molded within the cover portion 64 along a significant length in the plane of the cover portion 64. The conductive path 100 also includes a second conductive portion 104 (best seen in FIGS. 8 and 9, but also illustrated in FIGS. 3 and 4) which is electrically connected to the first conductive portion 102. The second conductive portion 104 is disposed for electrical contact engagement with a widened contact surface or hub portion 106 of the first lever arm assembly 74.

Specifically, the first conductor portion 102 is a generally planar thin member or strip. The first conductor portion 102 also includes two threaded studs 108,110 at opposite ends of the member 102 (FIG. 6). As seen in FIGS. 6 and 3, the studs 108,110 extend or project from the cover portion 64. The cover portion 64 in the vicinity of the stud 108 includes a recessed portion 112. As can be best seen in FIG. 3, the stationary auxiliary contact 46 is affixed to the cover portion 64 via a threaded sleeve portion at 114 which is threaded onto the threaded projecting portion of the stud 108 to affix the auxiliary stationary contact 46. It should be noted from the various figures, especially FIGS. 1–5, that the cover portion 64 includes an extending portion 116 that carries the stationary auxiliary contact 46 so as to extend beyond the adjacent portion 52 of the housing 50. This facility provides protection to the stationary auxiliary contact 46 from the environment while also providing clearance for cooperation between the moving auxiliary contact 44 and the stationary auxiliary contact 46 relative to the housing 50.

The second conductive portion 104 of the conductive path 100 is a generally planar thin member or strip. The second conductive portion 104 includes a passage 118 therethrough and is affixed over the stud 110 of the first conductive portion 102., the first and second conductive portions 102,104 being affixed to each other by a fastener 120 over the threaded projection of the stud 110 through the passage 118. The remote end 122 of the second conductive portion 104 is disposed out of the general plane of the member 104 and is fabricated with a curved or hooked portion 124 (best seen in FIG. 8) for desirable contact with the contact surface 106 of the first lever arm assembly 74. The conductive portions 102,104 are preferably fabricated from phosphor-bronze. The second conductive portion 104 has a spring temper characteristic so as to provide desirable contact pressure between the surface 106 and the curved portion 124 of 104; the curved section 124 operating as a wiper arm and the contact surface 106 operating as a wiper contact surface with respect to 124.

As can be seen in FIG. 3, the element 104 is disposed downward from the cover portion 64 as seen in FIG. 2 and contacts the surface 106 at the indicated position 125 when the operating mechanism is in the fully open position as shown in FIG. 2. Further, when the first lever arm 74 is rotated to the fully closed position in a clockwise direction in FIG. 2, contact between surfaces 106 and 124 is at the position 126 of the surface 106. Between the fully open and fully closed positions, contact is continuously made between 106 and 124 along the contact surface 106 between positions 125 and 126, although such contact is not required after the interrupting contacts 90,96 are opened. Thus, the complete shunt current path through the interrupter 12 includes the stationary auxiliary contact 46, the stud 108, the first conductive portion 102, the stud 110, the second conductive portion 104, the conductive portion of the operating mechanism 71, the movable contact plunger 82, contacts 90 and 96, the conductor 98, insert 61, and stud 62 external of the housing 50. As discussed, the stud 62 is affixed to the conductive bracket 18 which in turn carries the second terminal pad 16.

While there have been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letters Patent of the United States is:

1. An interrupting unit for an electrical power distribution switch comprising:

an insulative housing; and means for selectively providing an electrically conductive path therethrough comprising:

an operating mechanism disposed within said insulative housing and including a first movable member operable over a predetermined operating path;

contact means disposed within said insulating housing, defining open and closed position, and including a stationary contact and a movable contact, said movable contact being driven by said operating mechanism;

first conductive means communicating with the exterior of said housing being disposed within said insulative housing, and providing electrical connection to said stationary contact, said operating mechanism and said contact means including second conductive means for electrically connecting said first movable member to said movable contact; and stationary conductive-path-defining means for communicating with the exterior of said housing and providing electrical connection to said first movable member as said first movable member moves over said predetermined operating path, said stationary conductive-path-defining means including a contact portion having resilient characteristics for biasing said contact portion against said first movable member, said stationary conductive-path-defining means further comprising a conductive element that is integrally molded with said housing, said insulative housing comprising a first generally planar housing portion and a second housing portion that are arranged to interfit in a predetermined manner, said second housing portion of said insulative housing carrying said operating mechanism and said contact means, said first generally planar housing portion carrying said stationary conductive-path-defining means, said first generally planar housing including an overhanging section that extends beyond said second housing portion, said stationary conductive-path-defining means communicating with the exterior of said first generally planar housing portion within said overhanging section.

2. An interrupting unit including two interfitting insulative housing members which are assembled to provide a housing, a first of said two housing members including a first portion which is arranged to overhang and extend beyond said second housing member when said first and second members are assembled, said first housing member being generally planar and including an integrally molded conductor that is generally elongated and that communicates between first and second points of said first housing member, a first conductive fastening device being affixed at one end of said integrally molded conductor, said first conductive fastening device being located in said first portion of said first member such that said first conductive fastening device faces said second member.

3. The interrupting unit of claim 2 further comprising an elongated protruding conductive member affixed to said first conductive fastening device.

4. The interrupting unit of claim 2 further comprising a second conductive fastening device affixed to said other end of said integrally molded conductor and a conductive member affixed to said second conductive fastening device, said conductive member being generally elongated and having resilient characteristics.

5. The interrupting unit of claim 4 wherein said second housing member defines a receiving cavity, the interrupting unit further comprising an operating mechanism disposed within said receiving cavity of said second member, said operating mechanism including a movable conductive element having a predetermined operating path and being disposed relative to said conductive member so as to be engaged thereby during movement throughout said predetermined operating path.

* * * * *